United States Patent [19]

Korsmo et al.

[11] Patent Number: 4,483,392

[45] Date of Patent: Nov. 20, 1984

[54] AIR TO AIR HEAT EXCHANGER

[75] Inventors: Edward S. Korsmo, Minnetonka; Eugene R. Boedecker, Mound, both of Minn.

[73] Assignee: Xchanger, Inc., Hopkins, Minn.

[21] Appl. No.: 364,391

[22] Filed: Apr. 1, 1982

[51] Int. Cl.[3] ..... F28D 7/08

[52] U.S. Cl. ..... 165/150; 165/122; 165/151; 165/175; 165/DIG. 1

[58] Field of Search ..... 62/524, 525; 165/151, 165/152, 143, 144, 163, 174, 110, DIG. 1, 172, 165, 145, 122, 150, 175, 176; 261/DIG. 11

[56] References Cited

U.S. PATENT DOCUMENTS

| | | | |
|---|---|---|---|
| 1,788,068 | 1/1931 | Scott | 165/150 X |
| 2,054,404 | 9/1936 | Askin | 165/151 X |
| 2,759,248 | 8/1956 | Burgess | 165/174 X |
| 3,142,970 | 8/1964 | Hale | 62/524 X |
| 3,379,244 | 4/1968 | Gilli | 165/173 |
| 4,196,157 | 4/1980 | Schinner | 165/DIG. 1 |
| 4,232,729 | 11/1980 | Ingram et al. | 165/172 X |

*Primary Examiner*—Albert W. Davis, Jr.
*Attorney, Agent, or Firm*—Kinney & Lange

[57] ABSTRACT

An air to air heat exchanger maximizes the space that is available for cooling process air while keeping the pressure drop of the process air through the heat exchanger at a minimum and at the same time utilizes easily available components for manufacture. A pair of headers are provided in the air to air heat exchanger and the headers are connected with a plurality of tubes arranged in a triple tube arrangement such that there are a plurality of sets of three tubes in each set. The sets of tubes are spaced along the length of the headers. Each of the tubes are bent into an "S" shape so each tube has three lengths or sections extending from side to side of the heat exchanger between the input header and output header.

2 Claims, 4 Drawing Figures

FIG. 1
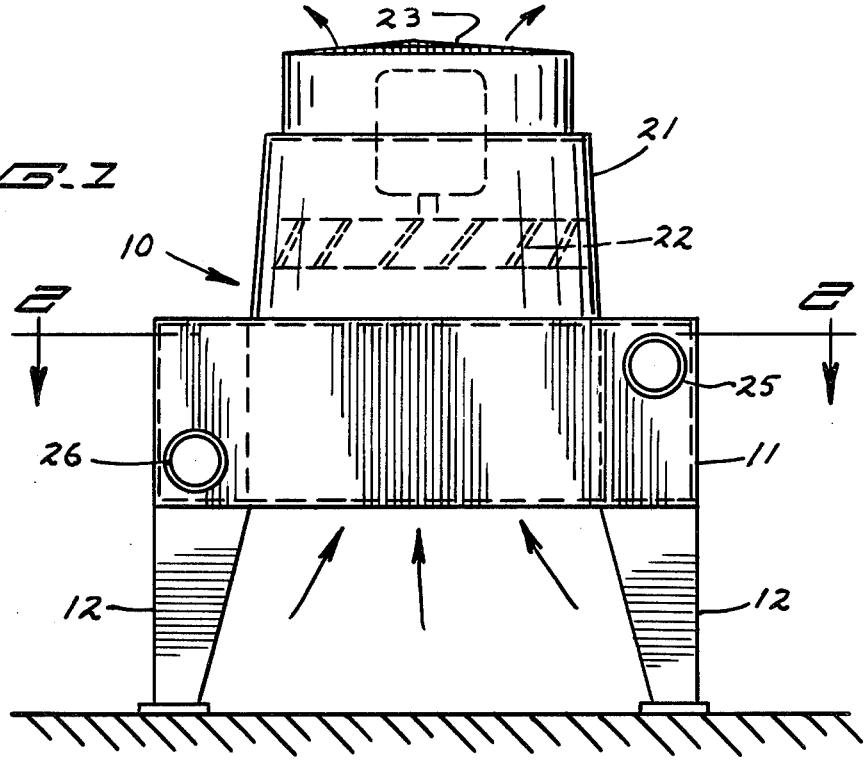
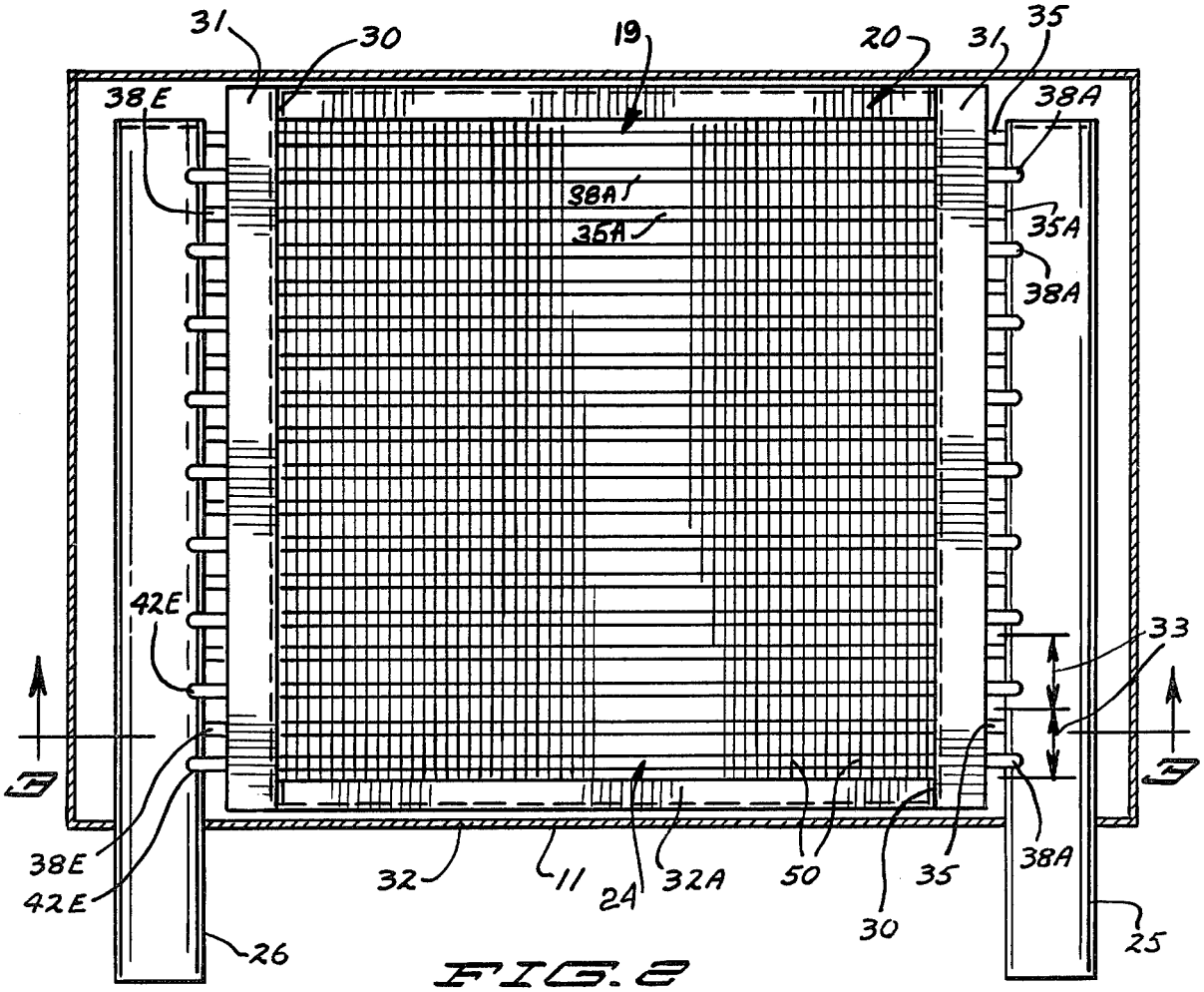
FIG. 2

AIR TO AIR HEAT EXCHANGER

BACKGROUND OF THE INVENTION

1. Field of the Invention.

The present invention relates to heat exchangers having low pressure drop and high efficiency and primarily used for air to air heat exchange.

2. Description of the Prior Art.

In the prior art various types of heat exchangers have been advanced. Examples of patents showing exchangers include U.S. Pat. No. 3,705,621, which has two passes of each of the cooling tubes across the heat exchanger between an inlet and outlet header. U.S. Pat. No. 3,428,117 shows a heat exchanger that has pipes which are curved back and forth from the input manifold or header so that they have five lengths of pipe extending across the exchanger. This is designed specifically for nuclear power plants, and involves quite expensive construction.

U.S. Pat. No. 3,063,682 shows a heat exchanger that has tubes that are curved back and forth across the heat exchange area so that the supply and return headers or pipes are on the same side of the exchanger. However, the tubes have axes which lie in a single laterally extending plane.

U.S. Pat. No. 3,020,024 shows a plurality of tubes on the inlet and outlet sides of an exchanger that merely go out and double back from the inlet to the outlet. At the inlet chamber there are four stacked tubes that extend out at the end of the heat exchanger and then back.

The use of a cross flow of cooling air that goes generally transverse to the longitudinal axes of tubes carrying the fluid to be cooled is also known. Problems exist because of high pressure drops in the exchanger where low pressure air needs to be cooled while using a minimum of space for the heat exchanger.

SUMMARY OF THE INVENTION

The present invention relates to a heat exchanger that makes maximum use of the available space for cooling a process gaseous fluid, such as air or another gas under relatively low pressure. A tubular header is provided for input of the gas to be cooled to the exchanger. Three rows of tubes extend laterally from the header and carry the gas to be cooled. The rows lie in three different elevation planes extending laterally from the input header. The tubes are directed laterally back and forth in three passes across the heat exchange area, before being connected to an outlet header.

The axes of the tubes that enter the heat exchange area are at three levels relative to a central plane extending longitudinally along the header. The tubes have first straight lengths extending laterally from the intake header, first curved end portions that result in a 180° change in direction, second straight lengths extending back toward the intake header, second curved end portions, again resulting in a 180° change in direction of each tube and third straight lengths extending to the output header, which is on the opposite side of the heat exchange area from the input header. The tubes that carry the process gas are relatively small diameter and have fins thereon. The tubes are arranged in "sets" of three tubes with one tube from each row being in a set. The curved end portions of the tubes are arranged to conserve space by having the curved end portion of one of the tubes from each of the sets positioned to the outside of the curved ends of the other two tubes in that set so that the arrangement of the sets of three tubes, each with three lengths or sections extending across the heat exchange area, are easily accommodated in a minimum space. The use of the multiple rows of tubes coming laterally from the input header at different elevations provides for a minimum pressure drop across the heat exchanger using standard components.

The tubes are supported in an open center perimeter frame having side and end walls, with the straight lengths of the tubes in the heat exchange area and the curved ends to the outside of the frame side walls. A housing encloses the frame and tubes. A fan is used to provide airflow across the open center area of the frame for heat exchange.

BRIEF DESCRIPTION OF THE DRAWINGS

FIG. 1 is a side elevational view of a heat exchanger assembly made having a heat exchange unit made according to the present invention;

FIG. 2 is a fragmentary plan view taken on line 2—2 in FIG. 1 with parts in section and parts broken away;

DETAILED DESCRIPTION OF THE PREFERRED EMBODIMENT

Figure 3:
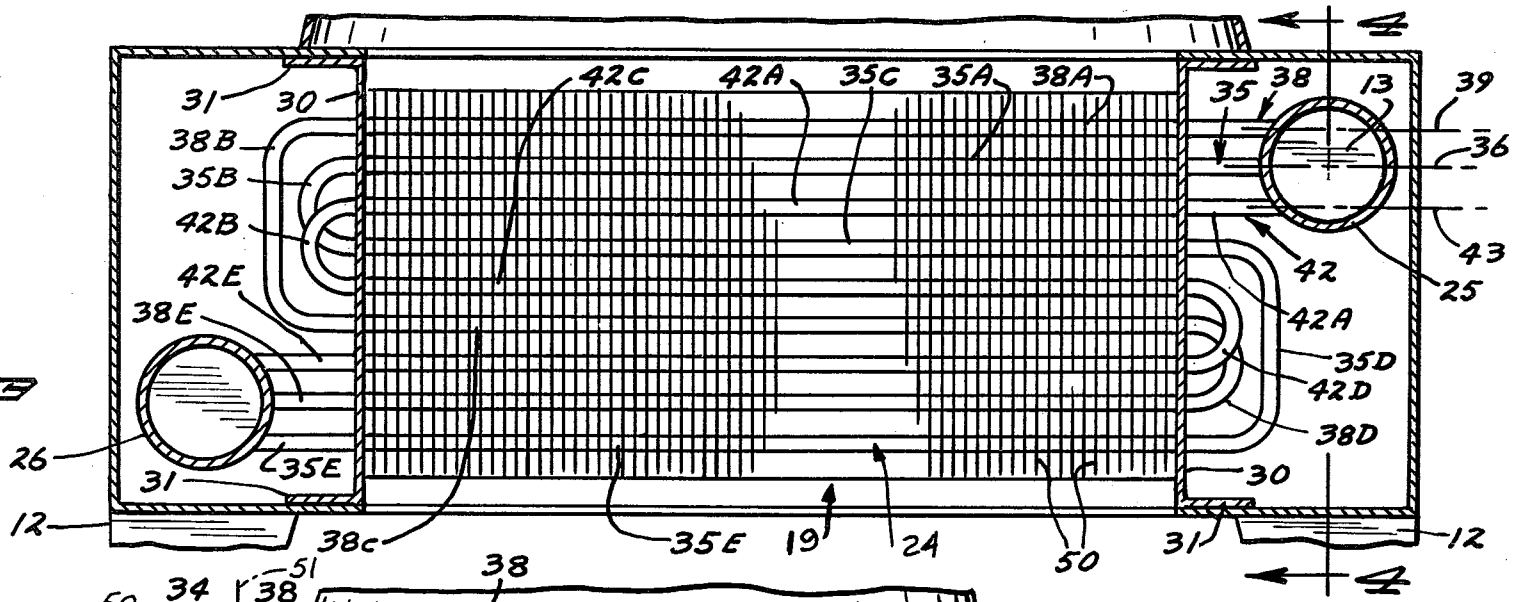
FIG. 3 is a sectional view taken as on line 3—3 in FIG. 2.

A heat exchanger assembly indicated generally at 10 includes an outer frame or housing 11, supported on legs 12. The legs 12 are spaced apart to form an air space underneath the housing. The housing 11 defines a chamber for providing an air coil support frame (see FIG. 2) indicated at 20. The air coil support frame 20 comprises a rectangular perimeter frame that in turn defines an open central area 19. A fan housing 21 is mounted on the housing 11, and includes a fan shown only schematically at 22 for drawing air inwardly from the bottom of the housing 11 through the open central area of the air coil frame 20 and discharging the air upwardly through a grill indicated at 23.

The housing just described is conventional for holding heat exchange coils. The device of the present invention is designed primarily as a heat exchanger for relatively low pressure process fluids, primarily gases, that are heated during compression or in another part of the process (for example air in pneumatic conveying systems) and which are to be cooled for use. In one example, input process gas (air) from a pneumatic conveying system may be at a pressure of 15 psi gauge or lower and at input temperatures in the range of 250° to 275° F. It is desired that the air to be cooled to approximately 100° F. The heat exchanger can withstand higher input pressures, but the lower pressure drop is especially important where the input pressure is under 45 psi.

Prior heat exchangers have utilized air coils that have too high a pressure drop for satisfactory use, or required extensive size for operation at relatively low input gaseous pressures.

Ambient air is drawn in between the legs 12,12 and across a tube assembly 24 in the open center area 19 by the fan 22 and discharged out through the grill 23. Thus ambient air is used as a cooling fluid medium for the process gas that is passed through the tubes of the tube assembly.

Figure 4:
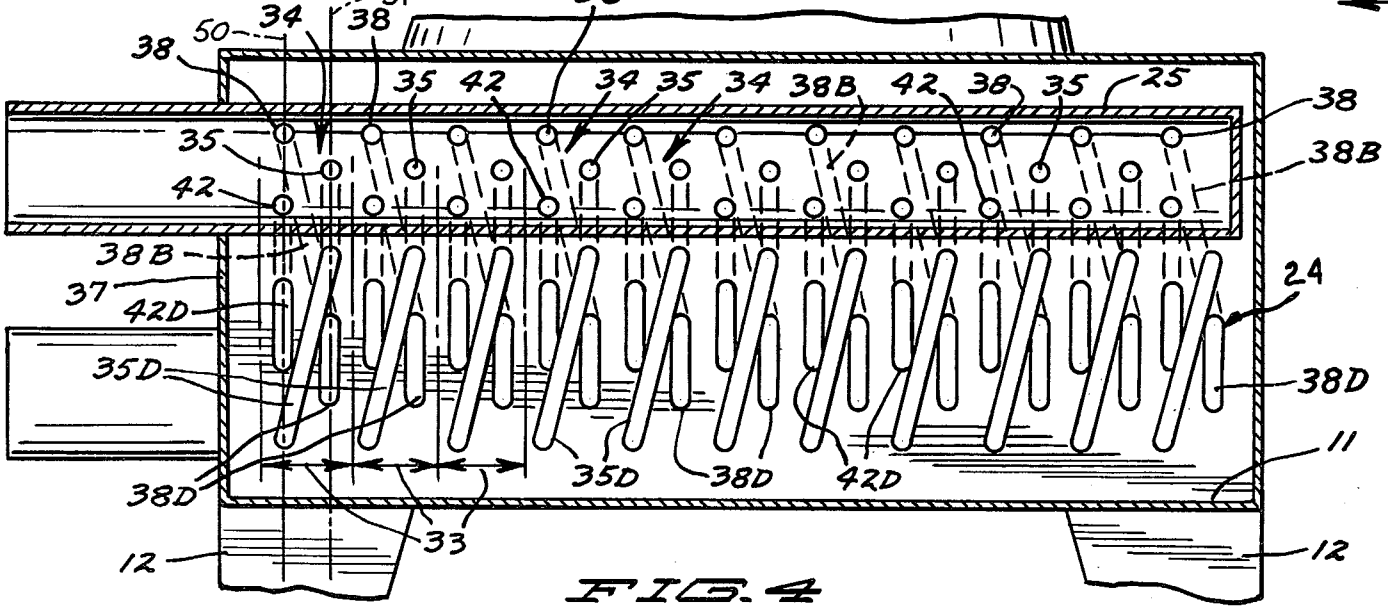
FIG. 4 is a fragmentary sectional view taken as on line 4—4 in FIG. 3.

Referring to FIGS. 2, 3 and 4 in particular, the tube assembly 24 includes an input fluid (air) header or manifold 25 which is a round tube having a central longitudinal axis extending along one side of the air coil frame 20, and an output header 26 comprising a round tube that is on an opposite side of the air coil frame 20 which has an axis generally parallel to the axis of the header 25. Header 26 is offset from header 25 in a vertical (height) direction. The terms vertical, upper and lower are used for convenience in describing the present device, and it should be understood that while the device is shown supported for vertical flow of air across the tube assembly, it could be mounted on its side or any angle so that the cooling air moved horizontally, rather than vertically.

The air coil frame 20 includes spaced apart side walls 30,30 which have upper and lower flanges 31, that are used for providing strength and also for attaching the frame 20 and tube assembly 24 to the housing 11. The frame 20 also has end walls 32,32 which join the side walls 30,30 and define an open central area. The end walls 32 also have flanges 32A at the top and bottom for strength.

The tube assembly 24 is made up of a plurality of suitable heat conductive tubes (for example, copper or stainless steel tubes), that extend from the first or input header 25 to the second or output header 26 and pass across the open area 19 defined by the air coil frame three times so that it is a triple pass tube configuration. The tubes are arranged so that they are also in sets of three tubes, formed by one tube from from each of the rows of tubes in vertical or height direction of the header. This is indicated in FIG. 4 by the three tubes forming one set indicated at 34 on each longitudinal segment 33 of the header. Each set 34 at the input header includes a first or center tube 35, a second or upper tube 38 and a third or lower tube 42. There are a plurality of the tube sets 34 extending along the length of the headers. Each tube 35 of each set extends laterally from the input header 25 with a first straight length 35A. This tube length 35A has an axis 36 which lies along a diametral line of the header 25, and thus tube axis 36 is centered on the header and extends laterally therefrom.

The two other tubes 38 and 42 of each triple tube set 34 are offset in height direction (parallel to the direction of cooling airflow) from this axis 36. The upper tube 38 of each triple tube set 34 has a first length 38A having an axis 39 that defines a chordal line across the header 25 parallel to the axis 36, but offset in height direction from the diametral line. The third tube 42 of each triple tube set 34 has a straight length of tube 42A having an axis 43 that defines a chordal line extending across the header 25 parallel to the axis 36, and offset from this diametral line an amount substantially equal to the offset of the axis 39, but in opposite direction from axis 36.

In FIG. 3, it can be seen that the axes 36, 39 and 43, respectively lie substantially in parallel spaced planes and these planes are parallel to the axis of the header. The end openings of the tubes in each set open at three separate annular positions on the header tube 25. Stated another way, the centers of the openings for the tubes in each set are at separate radial position with respect to the central axis of header 25 when viewed in cross section.

The tubes also each make a triple pass side to side across the air coil frame, and are arranged so that they are compact. Several tubes spaced in height dimension along the side of the header tube tend to reduce the pressure drop of the process air through the tube set 24. The tubes in the set 34 each have fins for increasing the heat dissipation in a known manner. The fins can be spaced as desired along the length of the tubes and are installed in a conventional manner on the straight lengths of the tubes.

The first straight length or section 35A of tube 35 extends from the input header 25 through a first of the side walls 30 of the air coil frame, across the open space 19 defined by the frame, and through the second of the side walls 30. A first small tube bend section 35B is positioned outside of the second side wall 30 of the air coil frame and joins first tube length 35A to a second tube length 35C. The length 35C extends back through a second of the walls 30 toward the header 25 and is parallel to and spaced in height direction from the first tube length 35A.

The second tube length 35C passes through the first of the side walls, and a long bend section 35D on the outside of the first wall 30 joins the tube length 35C to a third straight tube length 35E. The length 35E extends across the open area 19, through the second side wall 30 and opens into the output header tube 26. The bend section 35D is offset or angled, as shown, so tube length 35C is at a different location as viewed in longitudinal direction of the headers than the tube length 35E. As will be explained, the longer bend sections are used to prevent interference with the bends of the other tubes in each set at the opposite sides of the air coil frame.

The tube 38 of each set 34 has an axis 39 which is spaced from and is on a first side of the axis 36. Tube 38 includes a straight length or section 38A extending laterally from the input header tube 25. The length 38A extends laterally across the open area 19 of the air coil frame through the side walls 30,30 and has a bend section 38B positioned outside of the second side wall 30. The bend section 38B connects the first length 38A to the second straight length 38C of the tube 38. The length 38C passes through both of the side walls 30, and the bend section 38B is on the outside of the second side wall. Length 38C then extends back toward the header tube 25 and back through the first side wall 30 of the air coil frame.

The bend section 38B, as can be seen, is a large bend (long) to provide for the uppermost tube length 38A of each tube set to be continued below the lengths of the other tubes in such set. The tube lengths are spaced apart in height dimension, which is the dimension generally parallel to the direction of cooling airflow. The bend section 38B overlies the bend section 35B at that end of the tube assembly.

The length 38C is also offset in longitudinal direction of the input header from the tube length 38A. The length 38C passes back through the first side wall 30 adjacent the header tube 25 and a smaller size tubular bend section 38D outside of the first side wall 30 couples tube length 38C to another straight length 38E of tube 38. Tube length 38E extends out through the second side wall 30 and is connected to discharge or output header tube 26 along a diametral line of the tube 26.

As stated, the tube 42 has an axis 43 forming a lower chordal line on the input header 25 as shown in FIG. 3. The straight tube length 42A of tube 42 extends laterally out from the header 25 between the side walls 30,30 across the open area 19 and a bend section 42B is formed outside the second side wall 30. This is a small bend section substantially the same size as bend section 35B, and joins tube length 45A to a straight tube length 42C that extends back across the open area 19 toward the input header 25. The tube length 42C joins a bend section 42D which in turn joins a straight tube length 42E extending across the open area 19 in direction away from the header 25 back toward the output header 26. Tube length 42E joins the header 26 above the header center line, so that the axis of the tube section 42E forms an upper chordal line. The tube lengths 42A, 42C and 42E are spaced from each other in height direction, or in other words in direction parallel to the cooling airflow and also are spaced from the straight lengths of other tubes.

It can thus be seen that tube bend sections 38B and 35D are long enough to span the bend sections of the other two tubes of the same set at the same end of the frame. Each of the longer bend sections 38B and 35D is offset axially with respect to the longitudinal direction of header tubes 25 and 26 from the commencement of the bend section to the end of the bend as shown perhaps best in FIG. 4 where the bend section 36D is shown. Note that the input end of the bend section 36D at the upper portion of FIG. 4 is at a different, longitudinal axial position with respect to the axis of the input header tube 25 than the output end of the bend section and spans and overlies the bend sections of the two other tubes of the set from the top to the bottom.

The same is true of the bend section 35B, in that it is offset axially from its commencement at its upper end to its junction with the straight lengths 38C, and it too spans the bend sections 35B and 42B. This permits the triple tubes to each make a triple pass across the open area 19, and to be very compact in arrangement.

As can be seen in FIG. 4, the axes of the tube lengths of each set lie on two planes perpendicular to the longitudinal axes of the headers. In other words, there is a first plane 50 passing through the axes of the first lengths of tubes 42 and 38 of each set, which also passes through the axes of the second lengths of other tubes, and a second plane 51 passes through the axis of the tube 35 and the axes of second and third lengths of other tubes in the same set. These planes are both within each longitudinal space for each set of tubes, which is indicated by the double arrows 33 in FIG. 4. It can be seen that the axis of the tube length 38C (the second length of tube 38) shifts from reference plane 50 to the plane 51 passing through the axis of the tube 35, and the axis of the tube length 35E (the third length of tube 35) shifts over to the reference plane 50 defined by the first lengths 38A and 42A. The axes of all of the tube lengths for tube 42 remain in the reference plane. This arrangement provides for a compact space saving multiple pass gaseous fluid heat exchanger, and the bend sections accommodate the shifting of relative position of the different tube lengths.

The tubes are provided with a number of heat conducting fins for radiant cooling indicated at 50 on each of the straight lengths of tube, and these can be of any desired design forming individual fins on each of the tube lengths. Generally, the fins have openings with small collars around the openings. The fins an be slid onto the tube lengths and then the tube lengths are expanded with internal fluid pressure to secure the fins in place. Standard tube couplings can be utilized to couple the bend sections to the straight lengths so that the bend sections can be assembled from the opposite ends.

The frame for the tube assembly can be supported in the housing 11 in any desired manner such as with clips, bolts, or with vibration isolation devices if fan vibration is excessive.

The headers may be connected in parallel by extending the length of the input and output headers for greater capacity if desired.

The use of sets of standard copper tubes which each make a triple pass, with bends formed to minimize the space requirements, provides for an efficient, low cost and highly satisfactory air to air heat exchanger.

Although the present invention has been described with reference to preferred embodiments, workers skilled in the art will recognize that changes may be made in form and detail without departing from the spirit and scope of the invention.

What is claimed is:

1. A heat exchange apparatus for cooling gases, such as air from an industrial process, with a cross flow of cooling air comprising:

a frame defining an open central area through which cooling air will flow and having side frame members that are spaced apart;

a first input header member for receiving the gas to be cooled adjacent and to the exterior of one of the side frame members;

a second header member for discharging the cooled gas adjacent and to the exterior of a second of said side frame members;

each of said header members having a longitudinal axis extending generally in the same direction as the axis of the other and having a lateral width in a direction measured between the second header members, and a height direction that is measured generally perpendicular to the lateral direction when viewed in a cross section along a plane perpendicular to the longitudinal axis and which height direction is generally parallel to the normal direction of flow of cooling air;

a plurality of sets of heat conductive tubes connected to the first header member and in fluid communication therewith, each set of tubes comprising first, second and third continuous tubes for carrying gas to be cooled coupled to the first header member on a side thereof facing toward the second header member, each tube having a first, a second and a third length;

the first and second tubes each having first lengths joining the first header with axes lying in a reference plane perpendicular to the longitudinal axis of the first header and being spaced apart in height direction to lie near the edges of the first header in height direction and the third tube of each set having a first length joining the first header and being offset longitudinally from the reference plane and substantially midway in the height direction of the first header;

the tubes having first bend portions joining the first tube sections adjacent the second side frame member on the exterior of the frame, second lengths of the first, second and third tubes joining the first bend portions and extending back toward the first side frame member, the second lengths being positioned offset in height direction from the first lengths and the axes of the second lengths of the first and third tubes lying in a second plane parallel to the reference plane and passing through the axis of the first length of the third tube, the axis of the second length of the second tube lying on the reference plane and the second length of the second tube being positioned substantially midway in height direction between the second lengths of the first and third tubes;

the tubes having second bend portions positioned adjacent and to the exterior of the first frame member and connected between the second and third lengths of the tubes, the third lengths extending back toward the second frame member, and being offset in height direction from the second lengths and also offset in height direction from the first lengths, the second bend portions placing the axes of the third lengths of the third and second tubes on said reference plane and spaced apart in height direction, and the axis of the third length of the first tube being on the second plane and midway in height direction between the third lengths of the second and third tubes;

the first bend portion of the first tube spanning the first bend portion of the second and third tubes and the second bend portion of the third tube spanning the second bend sections of the first and second tubes;

the first, second and third lengths of each tube spanning the open central area, the ends of the third lengths of each tube of each set opening to the second header to discharge process gases; and means to create a cooling airflow through the open central area across all of the tube lengths.

2. The exchanger of claim 1 and plurality of heat conducting fins mounted on each of the straight lengths of tubes.

* * * * *